US008166927B2

(12) United States Patent
Fukuoka

(10) Patent No.: US 8,166,927 B2
(45) Date of Patent: May 1, 2012

(54) OUTBOARD MOTOR

(75) Inventor: Yoshihito Fukuoka, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 505 days.

(21) Appl. No.: 12/431,941

(22) Filed: Apr. 29, 2009

(65) Prior Publication Data

US 2010/0126439 A1 May 27, 2010

(51) Int. Cl.
*F01P 5/10* (2006.01)
*F02N 1/00* (2006.01)

(52) U.S. Cl. ..... 123/41.44; 123/198 C; 123/198 E; 440/88 P

(58) Field of Classification Search ..... 123/41.44, 123/41.47, 198 C, 195 P, 196 W, 198 E; 440/88 R, 440/88 C, 88 P, 88 M
See application file for complete search history.

(56) References Cited

U.S. PATENT DOCUMENTS 2,676,559 A * 4/1954 Davies ..... 440/53
4,565,534 A * 1/1986 Bland ..... 440/88 R
4,993,979 A * 2/1991 Bland et al. ..... 440/75

FOREIGN PATENT DOCUMENTS

JP 3509171 B2 3/2004

* cited by examiner

*Primary Examiner* — Noah Kamen
*Assistant Examiner* — Hung Q Nguyen
(74) *Attorney, Agent, or Firm* — Keating & Bennett, LLP

(57) ABSTRACT

An outboard motor that facilitates replacement of an impeller of a water pump includes a water pump arranged to pump coolant and a pump driving mechanism arranged to distribute power from a drive shaft to the water pump. At least a portion of the water pump in which an impeller is housed can be detached and attached from the outside of an upper case. The pump driving mechanism distributes power in a direction generally perpendicular to the axial direction of the drive shaft and transmits the power to the water pump.

10 Claims, 6 Drawing Sheets

OUTBOARD MOTOR

BACKGROUND OF THE INVENTION

1. Field of the Invention

The present invention relates to outboard motors including a water pump for pumping coolant.

2. Description of the Related Art

Generally, in outboard motors, a water pump for pumping coolant for cooling an engine and so forth is disposed around a connection portion between an upper case defining a section below the engine and a lower case joined to a lower section of the upper case. A drive shaft transmitting rotation of the engine to a propeller shaft passes through the water pump in the vertical direction. An impeller of the water pump is arranged to unitarily rotate with the drive shaft. Thereby, the water pump is directly driven by the drive shaft (for example, see JP-B-3509171).

Since the impeller is generally made up of materials that will be gradually worn or torn, it is necessary to periodically replace the impeller.

However, to replace the impeller of the water pump, heavy maintenance has to be performed such that a boat on which the outboard motor is mounted is taken out of the water and moved to dry land, the connection portion by which the upper case and the lower case are joined together in the outboard motor is disassembled, and the water pump is taken out. It is necessary to detach and attach a large number of bolts and to reseal to waterproof the casing members. Therefore, maintenance is very difficult.

Further, since the water pump is provided in the upper case and the lower case, there is a limit in the diameter of a pipeline member connected to the water pump due to an inside space of each case, thus resulting in a limit in the improvement in the discharge performance of the water pump.

SUMMARY OF THE INVENTION

In order to overcome the problems described above, preferred embodiments of the present invention provide an outboard motor that improves maintainability in replacing an impeller of a water pump and increases layout flexibility of the water pump and pipes around the water pump.

A first preferred embodiment of the present invention provides an outboard motor in which an engine is installed above a casing and an output of the engine is transmitted to a propeller shaft via a drive shaft pivotally supported in the casing, the outboard motor including: a water pump arranged to pump coolant; and a pump driving mechanism arranged to distribute power from the drive shaft to the water pump, in which at least a portion of the water pump in which an impeller is housed can be detached and attached from the outside of the casing.

In a second preferred embodiment of the present invention, the pump driving mechanism is preferably arranged to distribute power from a direction that is different from an axial direction of the drive shaft to the water pump.

In a third preferred embodiment of the present invention, the pump driving mechanism is preferably arranged to distribute power from a direction generally perpendicular to the axial direction of the drive shaft to the water pump.

A fourth preferred embodiment of the present invention provides the outboard motor in accordance with any of the preferred embodiments described above, wherein the water pump is provided on a side surface of the casing and above a draft line of the outboard motor in a state that the engine is stopped.

A fifth preferred embodiment of the present invention provides the outboard motor in accordance with any of the preferred embodiments described above, wherein power is distributed along a power transmission path connecting the engine and a transmission device pivotally installed around the drive shaft together.

Further, a sixth preferred embodiment of the present invention provides the outboard motor in accordance with any of the preferred embodiments described above, further including a pump opening formed in a portion of the casing which corresponds to the water pump, and at least the portion of the water pump in which the impeller is housed protrudes outside from the pump opening.

A seventh preferred embodiment of the present invention provides the outboard motor in accordance with any of the preferred embodiments described above, wherein an inner casing member on which the water pump is mounted is provided in the casing, a plurality of components of the water pump are interposed between the inner casing member and the portion of the water pump in which the impeller is housed, the portion in which the impeller is housed and the plurality of components are together fastened to the inner casing member by a first bolt, and the plurality of components are fastened together by a second bolt.

An eighth preferred embodiment of the present invention provides the outboard motor in accordance with any of the preferred embodiments described above, wherein an inner casing member on which the water pump is mounted is provided in the casing, a plurality of components defining the water pump are interposed between the inner casing member and the portion of the water pump in which the impeller is housed, the plurality of components are together fastened to the inner casing member by a first bolt, and the component in which the impeller is housed and another component which contacts the component part in which the impeller is housed are fastened together by a second bolt.

Further, a ninth preferred embodiment of the present invention provides the outboard motor in accordance with any of the preferred embodiments described above, in which a coolant suction port and a coolant discharge port of the water pump are provided in the component in which the impeller is housed, and pipeline members connected to the coolant suction port and the coolant discharge port are formed with flexible hoses.

In accordance with the first preferred embodiment of the present invention, at least the portion of the water pump in which the impeller is housed can be detached and attached from the outside of the outboard motor. Therefore, maintainability in replacing the impeller can be vastly improved.

In accordance with the second preferred embodiment of the present invention, the water pump can be disposed independently of the position of the drive shaft. This allows for an improvement in layout flexibility of the water pump.

In accordance with the third preferred embodiment of the present invention, the water pump can be disposed in a position remote from the drive shaft. This allows for a further improvement in layout flexibility of the water pump and also for an improvement in layout flexibility of pipework around the water pump.

In accordance with the fourth preferred embodiment of the present invention, the maintainability, basic performance, and the layout flexibility of the pipework of the water pump can be further improved. Also, water removal from the water pump in a state that the engine is stopped can be facilitated.

In accordance with the fifth preferred embodiment of the present invention, power is distributed from the drive shaft by the pump driving mechanism before rotation of the engine is converted by the transmission device, and the power is transmitted to the water pump. Therefore, variation in the driving rotational speed of the water pump can be reduced, thereby obtaining stable performance.

In accordance with the sixth preferred embodiment of the present invention, the maintainability of the outboard motor and the performance of the water pump can be further improved.

In accordance with the seventh preferred embodiment of the present invention, when the impeller is replaced, the other plurality of components constructing the water pump can be prevented from being unnecessarily disassembled. This allows for further improvement in the maintainability of the outboard motor.

In accordance with the eighth preferred embodiment of the present invention, the component of the water pump in which the impeller is housed can be detached with minimum man-hours required. This allows for further improvement in maintainability in replacing the impeller.

In accordance with the ninth preferred embodiment of the present invention, the layout flexibility of the pipeline members connected to the coolant suction port and the coolant discharge port can be largely improved. Accordingly, the pipeline members can have large diameters, thereby improving the basic performance of the water pump and at the same time largely improving assembly ease of the outboard motor. When the component in which the impeller is housed is detached in replacing the impeller, the pipeline members that are flexible hoses can be separated from the outboard motor, detachment and attachment of the pipeline members themselves are not required. Therefore, the maintainability of the water pump can be improved in this point also.

Other features, elements, arrangements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention will be described hereinafter.

Figure 1:
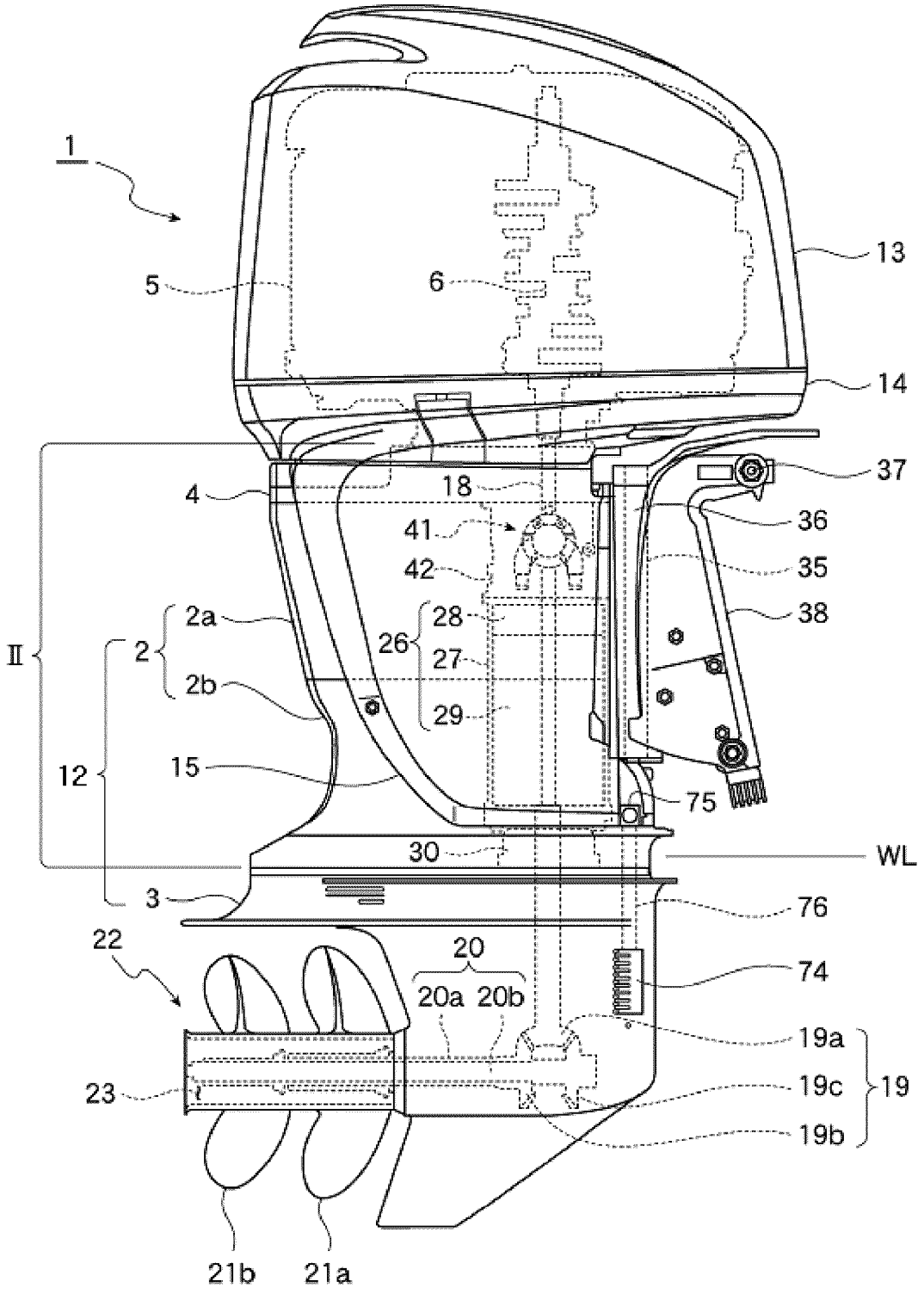
FIG. 1 is a right side view of an outboard motor in accordance with a preferred embodiment of the present invention.
Figure 2:
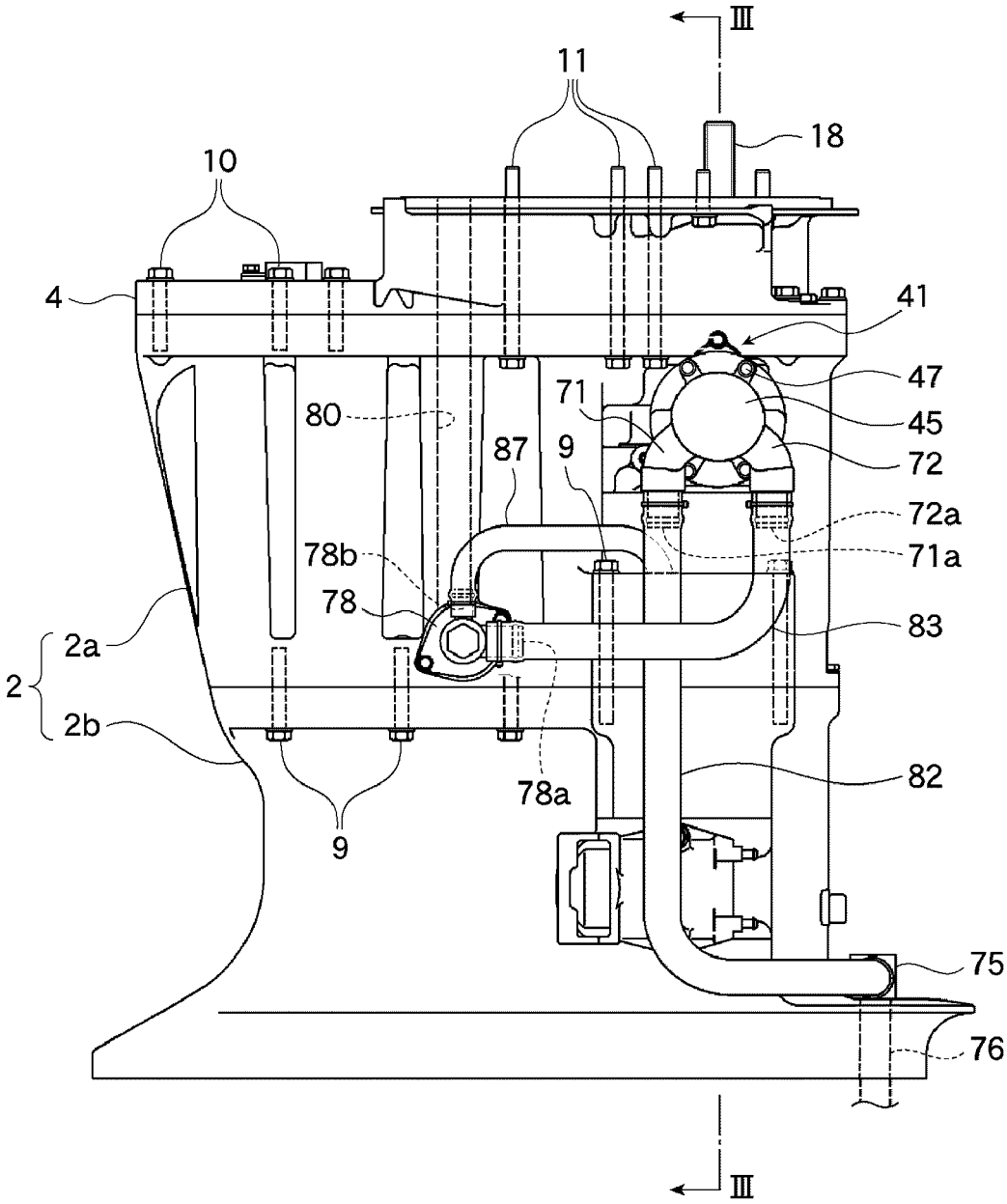
FIG. 2 is an enlarged view of section II in FIG. 1 in accordance with a preferred embodiment of the present invention.
Figure 3:
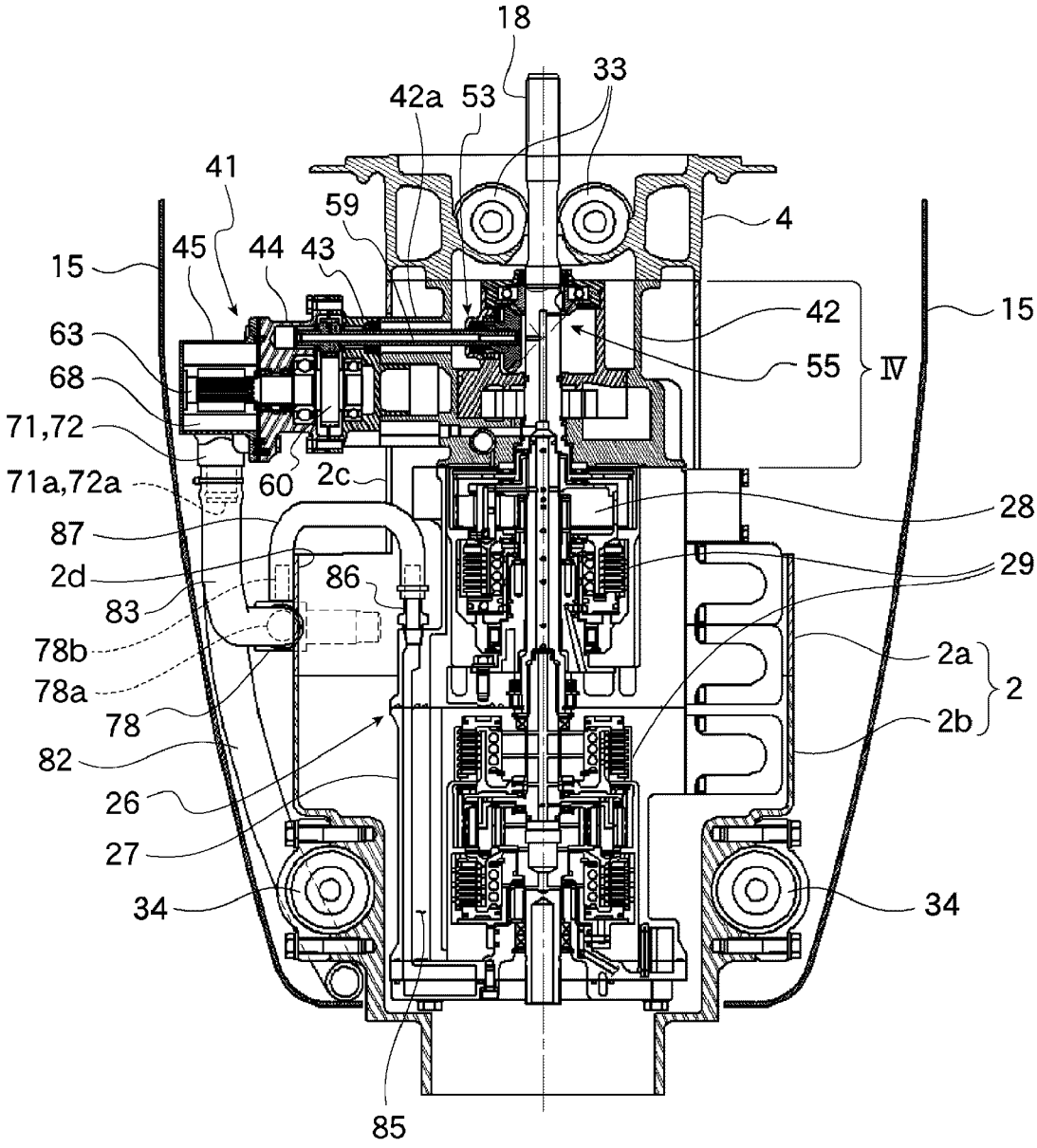
FIG. 3 is a vertical cross-sectional view taken along line III-III in FIG. 2 in accordance with a preferred embodiment of the present invention.

FIG. 1 is a right side view showing a preferred embodiment of an outboard motor in accordance with the present invention. FIG. 2 is an enlarged view of section II in FIG. 1. FIG. 3 is a vertical cross-sectional view taken along line III-III in FIG. 2.

An outboard motor 1 has a lower case 3 provided below an upper case 2 and an engine 5 installed in an upper portion of the upper case 2 via a generally plate-shaped mount plate 4. The engine 5 is, for example, a V-shaped six-cylinder water-cooled engine and is placed on the mount plate 4 with a crankshaft 6 thereof oriented in the vertical direction.

The upper case 2 has a block construction including an upper portion and a lower portion, for example, constructed in a manner such that an upper case section 2*a* and a lower case section 2*b* are fastened together by a plurality of fixing bolts 9. The mount plate 4 is fixed to an upper surface of the upper case section 2*a* by a plurality of fixing bolts 10 and through bolts 11. The lower case 3 is fixed to a lower surface of the lower case section 2*b* by fixing bolts (not shown). A casing 12 is defined by the upper case 2 and the lower case 3. The through bolts 11 are inserted from a lower side of an upper flange of the upper case section 2*a*, pass through the mount plate 4, and are tightened to the engine 5, thereby fastening the upper case section 2*a*, the mount plate 4, and the engine 5 together.

The engine 5 is covered by a detachable upper cover 13 and lower cover 14. Right and left side surfaces of the upper case 2 are covered by detachable side covers 15. FIG. 2 shows a state that the side covers 15 are detached.

A vertical drive shaft 18 is pivotally supported in the upper case 2. An upper end of the drive shaft 18 is coupled to a lower end of the crankshaft 6 of the engine 5 by spline-fitting, for example. The drive shaft 18 extends downward in the upper case 2, reaches the inside of the lower case 3, and is connected to a propeller shaft 20 horizontally and pivotally supported in the lower case 3 via a bevel gear mechanism 19.

The propeller shaft 20 preferably is a double rotational shaft in which an outer shaft 20*a* and an inner shaft 20*b* are coaxially combined. A drive bevel gear 19*a* of the bevel gear mechanism 19 unitarily rotates with the drive shaft 18. A driven bevel gear 19*b* unitarily rotates with the outer shaft 20*a*. The driven bevel gear 19*c* unitarily rotates with the inner shaft 20*b*. A first propeller 21*a* is fixed to the outer shaft 20*a*. A second propeller 21*b* is fixed to the inner shaft 20*b*. These members construct a counter-rotating propeller mechanism 22. An exhaust passage 23 is formed in the axial portion of the first propeller 21*a* and the second propeller 21*b*.

A transmission device 26 is provided in the upper case 2. The transmission device 26 is pivotally installed around the drive shaft 18. In the transmission device 26, a torque converter 28 and an automatic transmission device 29 including a forward-reverse changing system are housed in a transmission case 27 constructing the contour of the transmission device 26. A final speed reducer 30 with use of a planetary gear mechanism is provided right below the transmission device 26 (see FIG. 1).

When the engine 5 starts, rotation of the crankshaft 6 is transmitted to the drive shaft 18. Then, the rotational speed of the drive shaft 18 is changed in the transmission device 26 and the rotational direction is changed into the forward or reverse direction. Further, the rotational speed is reduced by the final speed reducer 30. The rotation is transmitted to the propeller shaft 20. The outer shaft 20*a* with the first propeller 21*a* and the inner shaft 20*b* with the second propeller 21*b* of the propeller shaft 20 rotate in directions opposite to each other, thereby generating a large propulsive force.

As shown in FIG. 3, a steering bracket (not shown) is coupled and fixed to a front portion of the outboard motor 1 via a pair of left and right upper mounts 33 included in the mount plate 4 and a pair of left and right lower mounts 34 provided on left and right side surfaces of the lower case section 2*b* of the upper case 2. The steering bracket is connected to a swivel bracket 36 by a vertical steering shaft 35 shown in FIG. 1. The swivel bracket 36 is coupled to a clamp bracket 38 via a horizontal swivel shaft 37 and a locking mechanism (not shown). The clamp bracket 38 is fixed to a transom of a boat.

The boat can be steered by turning the outboard motor 1 to left or right around the steering shaft 35 as an axis of rotation. The outboard motor 1 can be tilted up above the water surface by turning it up or down around the swivel shaft 37 as an axis of rotation.

Figure 4:
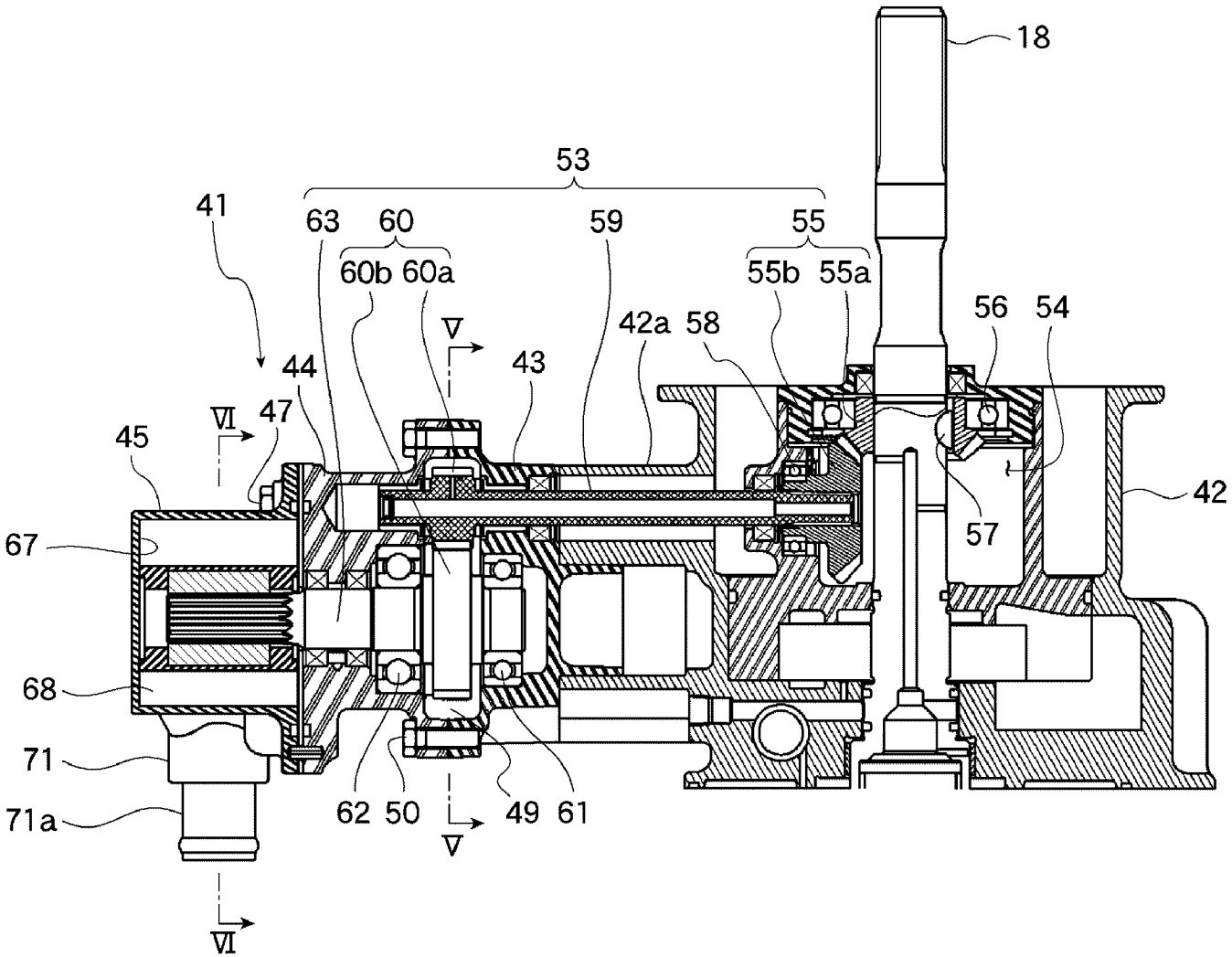
FIG. 4 is an enlarged view of section IV in FIG. 3 in accordance with a preferred embodiment of the present invention.
Figure 5:
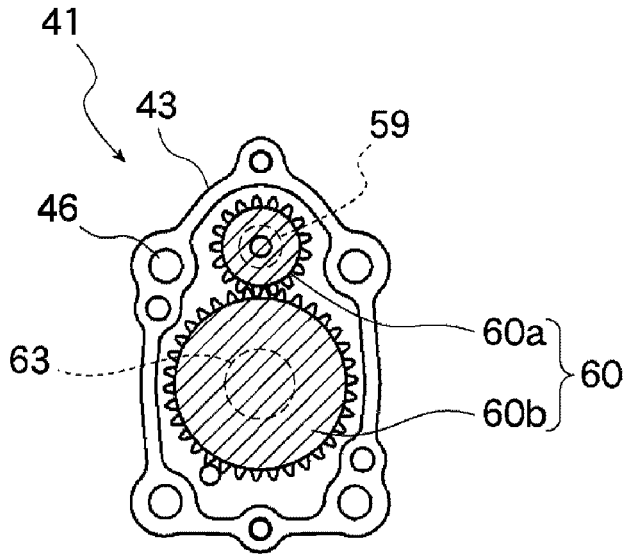
FIG. 5 is a vertical cross-sectional view taken along line V-V in FIG. 4 in accordance with a preferred embodiment of the present invention.
Figure 6:
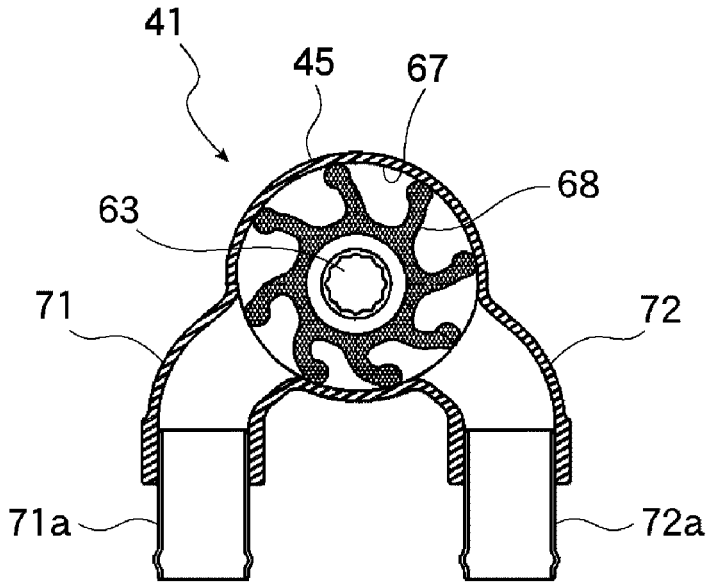
FIG. 6 is a vertical cross-sectional view taken along line VI-VI in FIG. 4 in accordance with a preferred embodiment of the present invention.

As also shown in FIGS. 4 through 6, a water pump 41 for pumping coolant out of the engine 5 is disposed on an outside surface of the upper case 2, for example, on a right side surface in the traveling direction of the boat. The water pump 41 is disposed at an elevation above the transmission device 26, and it is preferable that this position be sufficiently higher than the draft line WL (see FIG. 1) in a state that the outboard motor 1 is stopped.

A pump mount case 42 (inner casing member) separately formed is tightly fixed to an upper surface of the transmission case 27 of the transmission device 26 disposed in the upper case 2. An upper surface of the pump mount case 42 is tightly fixed to a lower surface of the mount plate 4.

An extension member 42*a* horizontally extending rightward is integrally formed on a right side surface of the pump mount case 42. Meanwhile, a pump opening 2*c* (see FIG. 3) is formed in a portion on a right side surface of the upper case section 2*a* of the upper case 2 and adjacent to the right side of the pump mount case 42. The extension member 42*a* of the pump mount case 42 protrudes rightward to the outside from the pump opening 2*c*. The pump opening 2*c* preferably has pockets at different levels and also opens downward.

An inner gear housing 43, an outer gear housing 44, and a pump housing 45 (the component in which the impeller is housed) are liquid-tightly mounted on the extension member 42*a* to be stacked to the right one after another. These three members (the inner gear housing 43, the outer gear housing 44, and the pump housing 45) and the extension member 42*a* define a main section of the water pump 41. As shown in FIG. 5, pump fixing bolts 47 (first bolts: see FIGS. 2 and 4) inserted from the outside in bolt holes 46 formed to pass through at four corners of each of the three members 43, 44, and 45 are tightened to the extension member 42*a*, thereby fastening the three members 43, 44, 45, and the extension member 42*a* together.

As described above, all of the inner gear housing 43, the outer gear housing 44, and the pump housing 45 defining the main section of the water pump 41 protrude outside from the pump opening 2*c* formed in the upper case 2. Therefore, the three members 43, 44, and 45 can be easily detached from the outside of the upper case 2 only by pulling out the pump fixing bolts 47. In this preferred embodiment, all of the inner gear housing 43, the outer gear housing 44, and the pump housing 45 defining the main section of the water pump 41 protrude outside from the pump opening 2*c* formed in the upper case 2. However, only the pump housing may be exposed outside of the upper case 2. Also, the pump housing may be provided in the upper case, and the pump opening may be widely formed so that the pump housing can be detached and attached from the outside of the upper case.

A speed reducing gear chamber 49 is defined between the inner gear housing 43 and the outer gear housing 44 in a watertight manner. Both the gear housings 43 and 44 are fastened together by two dedicated combining bolts 50 (second bolts) other than the pump fixing bolts 47.

Driving power for the water pump 41 is taken out from the drive shaft 18. The output of the drive shaft 18 is transmitted to the water pump via a pump driving mechanism 53 disposed in a power transmission path connecting the engine 5 and the transmission device 26. The pump driving mechanism 53 is provided in a portion, for example, from the pump mount case 42 (extension member 42*a*) to the inside of the water pump 41 and is constructed as described in the following so that power is taken out in a direction different from the axial direction of the drive shaft 18, for example, in the right direction perpendicular to the axial direction of the drive shaft 18 and the power is transmitted to the water pump 41.

A pump power take-out chamber 54 is defined in the pump mount case 42. A bevel gear mechanism 55 is installed in the chamber. The bevel gear mechanism 55 includes a drive bevel gear 55*a* arranged to be pivotally supported by a bearing 56 and to unitarily rotate with the drive shaft 18 via a woodruff key 57 and a driven bevel gear 55*b* pivotally supported by a bearing 58 and engaged with the drive bevel gear 55*a*. The gear ratio of the bevel gear mechanism 55 is preferably set to, for example, 1:1.

A pump drive shaft 59 extending along the width direction of the outboard motor 1 penetrates through the extension member 42*a* into the inside of the gear housings 43 and 44. A left end of the pump drive shaft 59 is coupled to the driven bevel gear 55*b* preferably by spline-fitting or the like to unitarily rotate therewith.

A speed reducing gear mechanism 60 is housed in the speed reducing gear chamber 49. The speed reducing gear mechanism 60 includes a speed reducing drive gear 60*a* and a speed reducing driven gear 60*b* engaged with the gear 60*a*. Both the gears 60*a* and 60*b* are, for example, helical gears, and the speed reduction ratio between the gears is preferably set to 1:2, for example.

The speed reducing drive gear 60*a* preferably is integral with the pump drive shaft 59 in a vicinity of a right end of the pump drive shaft 59. Meanwhile, an impeller shaft 63 is pivotally supported by a bearing 61 provided in the inner gear housing 43 and a bearing 62 provided in the outer gear housing 44. The speed reducing driven gear 60*b* preferably is integral with the impeller shaft 63. The rotational speed of the pump drive shaft 59 is reduced to the half speed by the speed reducing gear mechanism 60, and the rotation is transmitted to the impeller shaft 63.

The pump mechanism 53 is constructed to include the bevel gear mechanism 55, the pump driving shaft 59, the speed reducing gear mechanism 60, and the impeller shaft 63. The construction of the pump driving mechanism 53 is not limited to the above construction, but may be of other driving types.

A right end of the impeller shaft 63 eccentrically penetrates into an impeller chamber 67 defined in the pump housing 45. An impeller 68 is provided to unitarily rotate with the impeller shaft 63 in a manner such that a free end of the impeller 68 is fitted to the right end of the impeller shaft 63 preferably by spline-fitting or the like. The impeller 68 is preferably formed of elastic materials such as rubber and urethane in the shape of a water turbine with eight blades. The impeller shaft 63 and the impeller 68 are eccentric to the central axis of the impeller chamber 67. In addition, side surfaces of the impeller 68 and tips of the blades contact with left and right wall surfaces and a peripheral surface of the impeller chamber 67, thereby forming the water pump 41 as a vane pump.

A suction port 71 (coolant suction port) and a discharge port 72 (coolant discharge port) are provided in an outer periphery of the pump housing 45 in which the impeller 68 is housed. A suction union 71*a* and a discharge union 72*a* are provided in the suction port 71 and the discharge port 72, respectively. Both the suction port 71 (suction union 71*a*) and the discharge port 72 (discharge union 72*a*) point downward.

As shown in FIG. 1, a water intake 74 is provided on an outside wall of the lower case 3. As also shown in FIG. 2, a connecting union 75 is provided in an upper portion of a front end of the lower case 3. A water intake pipe 76 which extends upward from the water intake 74 and is connected to the connecting union 75 is disposed in the lower case 3.

As shown in FIGS. 2 and 3, a coolant branch section 78 formed into a three-way branch passage is provided on the right side surface of the upper case 2 (the upper case section 2*a*). The coolant branch section 78 includes a wide inlet union 78*a* extending toward the front of the outboard motor and a narrow branch union 78*b* extending upward. A coolant supply passage 80 extending upward from a mount of the coolant branch section 78 that supplies coolant to the engine 5 is formed in the upper case section 2*a* and the mount plate 4.

The connecting union 75 of the lower case 3 and the suction union 71*a* of the water pump 41 are connected by a flexible coolant suction hose 82. The discharge union 72*a* of the water pump 41 and the inlet union 78*a* of the coolant branch section 78 are connected by a flexible coolant discharge hose 83.

As shown in FIGS. 3 and 4, a water jacket 85 is formed in the transmission case 27 of the transmission device 26. A coolant introduction union 86 communicating with the water jacket 85 is provided on a right side surface of the transmission case 27. The branch union 78*b* of the coolant branch section 78 and the coolant introduction union 86 are connected by a flexible coolant branch hose 87. The coolant branch hose 87 is arranged such that it enters the inside from the outside of the upper case 2 across an outer periphery 2*d* of the pump opening 2*c* formed into the shape having pockets at different levels.

The diameters of the suction hose 82 and the coolant discharge hose 83 are larger than the diameter of the coolant branch hose 87. The difference in the diameter is determined in response to the ratio between the coolant sent to a water jacket of the engine 5 and the coolant sent to the water jacket 85 of the transmission device 26.

The coolant suction hose 82, the coolant discharge hose 83, and the coolant branch hose 87 are covered by the side covers 15 together with the water pump 41 and the pump opening 2*c*. Therefore, these members 82, 83, 87, 41, and 2*c* are not exposed in the external appearance of the outboard motor 1.

When the engine 5 of the outboard motor 1 operates, rotation of the drive shaft 18 is transmitted to the pump drive shaft 59 at a constant speed by the bevel gear mechanism 55 whose gear ratio preferably is set to 1:1. Thereafter, the rotational speed of the pump drive shaft 59 is reduced to the half speed by the speed reducing gear mechanism 60 whose gear ratio is set to 1:2 and the rotation is transmitted to the impeller shaft 63 and the impeller 68. The impeller 68 rotates clockwise in FIG. 6.

When the impeller 68 rotates in the impeller chamber 67 of the pump housing 45, outside water is drawn through the water intake 74 by negative pressure generated in the suction port 71. The water flows in the order of the water intake 74→the water intake pipe 76→the connecting union 75→the coolant suction hose 82→the water pump 41→the coolant discharge hose 83→the coolant branch section 78→the coolant supply passage 80, and is supplied to the water jacket (not shown) formed in the engine 5 as coolant. A portion of the coolant is branched into the coolant branch section 78 and supplied to the water jacket 85 in the transmission device 26 via the coolant branch hose 87.

Coolant that has cooled the engine 5 and the transmission device 26 passes through an exhaust expansion chamber (not shown) formed in the upper case 2 and the lower case 3 and the exhaust passage 23 formed in the axial portion of the first propeller 21*a* and the second propeller 21*b*, and is discharged into the outside water together with exhaust gas.

In the outboard motor 1, the pump housing 45 in which the impeller 68 is housed is arranged to protrude outside from the pump opening 2*c* of the upper case 2. The pump housing 45 is disposed at the elevation above the draft line WL. Therefore, when the impeller 68 of the water pump 41 is replaced, it is not required to land the boat. Further, the pump housing 45 can be easily detached by detaching only the side covers 15 and pulling out the pump fixing bolts 47. Therefore, the impeller 68 can be replaced easily and in a very short time. This allows a vast improvement in maintainability in replacing the impeller 68 and reduction in cost that would be incurred for the maintenance.

In addition, the inner gear housing 43 and the outer gear housing 44 that construct the watertight speed reducing gear chamber 49 can be kept fastened by the dedicated combining bolts 50 even though the pump fixing bolts 47 are pulled out. This makes it possible to avoid undesirable disassembling of the speed reducing chamber 49. Accordingly, both the gear housings 43 and 44 do not separate immediately after the pump fixing bolts 47 are pulled out. This prevents problems such as spilling of lubricating oil enclosed in the speed reducing gear chamber 49 and missing or damaging of the speed reducing gears 60*a* and 60*b* and reliably prevents an increase of unnecessary man-hours. This is advantageous particularly in the case of performing maintenance on the water.

The coolant suction hose 82 and the coolant discharge hose 83 respectively connected to the suction port 71 and the discharge port 72 of the pump housing 45 preferably are flexible hoses. Therefore, when the pump housing 45 is detached in replacing the impeller 68, the pump housing 45 can be easily separated from the outboard motor 1 by flexibly deforming both the hoses 82 and 83 without detaching the hoses beforehand. Maintainability is highly facilitated in this point also.

As described above, the suction port 71 and the discharge port 72 are provided in the pump housing 45 protruding from the upper case 2. This makes it possible to prevent the coolant suction hose 82 and the coolant discharge hose 83 from interfering with the upper case 2 and other devices, thus greatly increasing layout flexibility of pipes, which makes it possible to increase diameters of the pipe members 82, 83. Accordingly, the discharge performance of the water pump 41 can be improved.

Further, when the lower case 3 is mounted below the upper case 2, it is not required to perform difficult work as is required in conventional cases such that metal pipeline members disposed in the upper case 2 are fitted to the water pump disposed in an upper portion of the lowercase 3. The coolant suction hose 82 and the coolant discharge hose 83 can be easily connected to the water pump 41 from the outside. This largely contributes to an improvement in the assembly ease of the outboard motor 1.

The water pump 41 is provided above the draft line WL in the state that the outboard motor 1 is stopped. This facilitates water removal from the water pump 41 in the state that the engine 5 is stopped.

The pump driving mechanism 53 driving the water pump 41 is disposed in the power transmission path connecting the engine 5 and the transmission device 26. Rotation of the engine 5 (drive shaft 18) is transmitted to the water pump 41 via the pump driving mechanism 53 before the rotational speed is changed and/or the rotational direction is changed into the forward or reverse direction by the transmission device 26. This allows reduction in variation in the driving rotational speed of the water pump 41 and achieves stable performance.

The pump driving mechanism 53 takes out power in the direction (in the right direction in this case) perpendicular to the axial direction of the drive shaft 18 and transmits the power to the water pump 41. Therefore, the water pump 41 can be disposed in a position remote from the drive shaft 18 independently of the position of the drive shaft 18. This allows for a large improvement in layout flexibility of the water pump 41 and the pipework (82, 82, 87, and so forth) around the water pump 41.

Further, in the outboard motor 1, the pump mount case 42 separately formed is disposed on the upper surface of the transmission case 27 of the transmission device 26 disposed in the upper case 2. The extension member 42*a* formed on the right side surface of the pump mount case 42 protrudes outside from the pump opening 2*c* formed on the right side surface of the upper case 2. The water pump 41 is mounted on the extension member 42*a*. Therefore, there are no other large parts around the water pump 41.

Accordingly, it is required to detach only the right side cover 15 and the pump housing 45 when the impeller 68 of the water pump 41 is replaced. This results in a vast improvement in the maintainability of the outboard motor 1 and also an improvement layout flexibility of each of the hose members 82, 83, and 87. Accordingly, the hose members 82 and 83 can be formed to have large diameters, thereby improving the discharge performance of the water pump 41. The pump mount case 42 (extension member 42*a*) can be integrally formed with the mount plate 4 or the casing members such as the transmission case 27 depending on circumstances.

The outboard motor 1 is constructed such that the rotational speed of the drive shaft 18 is reduced to the half speed by the pump driving mechanism 53 and the rotation is then transmitted to the impeller shaft 63. Therefore, the discharge amount of the water pump 41 can be effectively prevented from reaching a limit, for example, in a case that the blade-tip circumferential speed of the impeller 68 excessively increases and cavitation occurs when the boat travels at high speed. The speed reduction ratio can be arbitrarily set by changing the gear ratio of the bevel gear mechanism 55 and/or the speed reducing mechanism 60.

Figure 7:
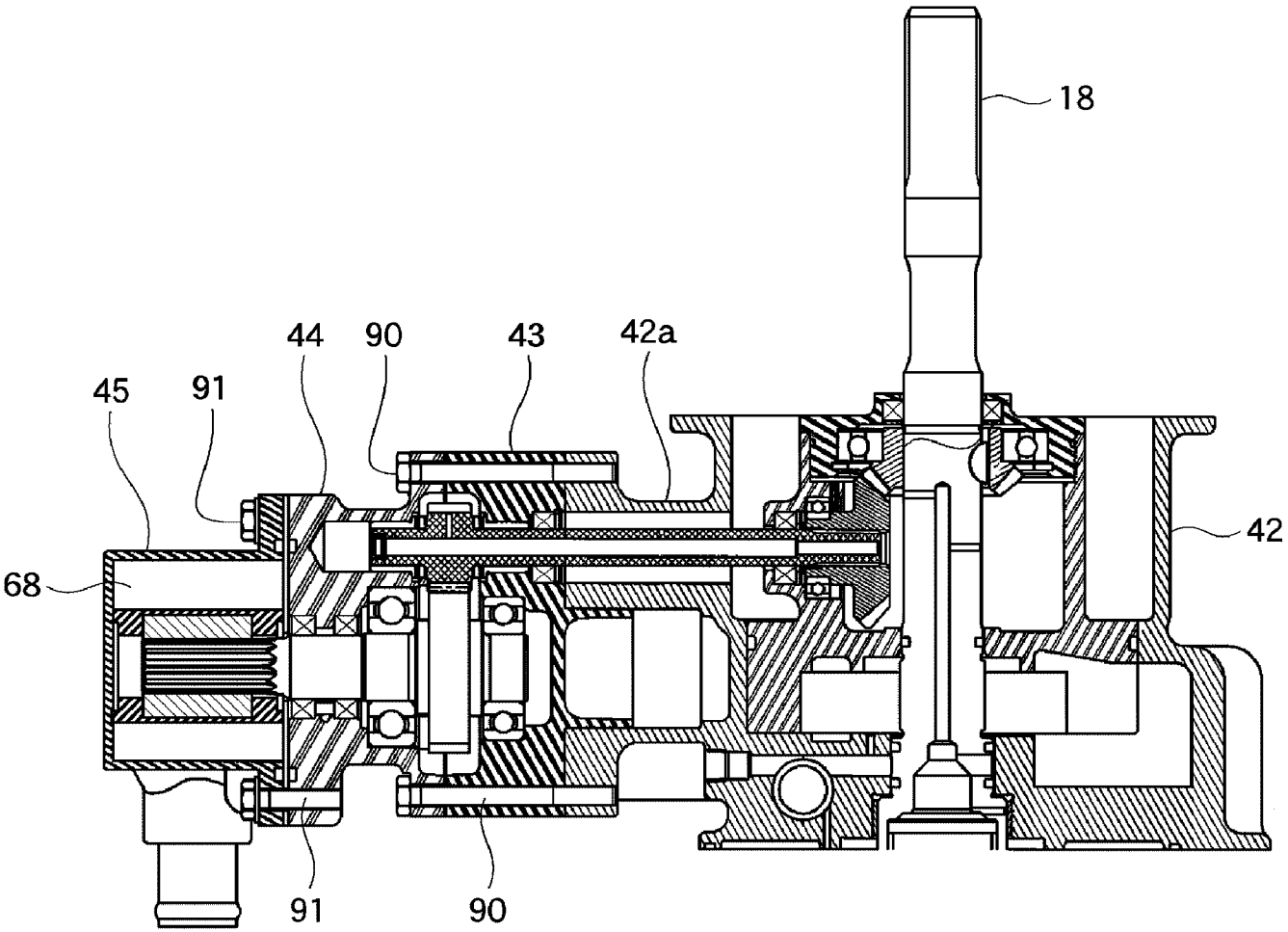
FIG. 7 is a vertical cross-sectional view showing another preferred embodiment of the present invention.

As in another preferred embodiment shown in FIG. 7, the outboard motor may be constructed in a manner such that the inner gear housing 43 and the outer gear housing 44 are together fastened to the extension member 42*a* of the pump mount case 42 by pump fixing bolts 90 (first bolts) and the pump housing 45 is fastened to the outer gear housing 44 contacting therewith by housing fixing bolts 91 (second bolts).

Accordingly, when the impeller 68 is replaced, the pump housing 45 can be detached only by removing the housing fixing bolts 91. The inner gear housing 43 and the outer gear housing 44 are not detached. Therefore, maintainability can be further improved.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An outboard motor comprising:

an engine;

a casing arranged to house a drive shaft, the casing being disposed directly below the engine;

a water pump including an impeller and arranged to pump coolant; and a pump driving mechanism arranged to distribute power from the drive shaft and transmit the power to the water pump; wherein at least a portion of the water pump in which the impeller is housed can be detached and attached from the outside of the casing.

2. The outboard motor according to claim 1, wherein the pump driving mechanism is arranged to distribute power in a direction different from an axial direction of the drive shaft and transmit the power to the water pump.

3. The outboard motor according to claim 1, wherein the pump driving mechanism is arranged to distribute power in a direction generally perpendicular to an axial direction of the drive shaft and transmit the power to the water pump.

4. The outboard motor according to claim 1, wherein the casing includes a left side surface and a right side surface and the water pump is provided on the left side surface or the right side surface of the casing and above a draft line of the outboard motor in a state that the engine is stopped.

5. The outboard motor according to claim 1, wherein power is distributed along a power transmission path connecting the engine and a transmission device pivotally installed around the drive shaft.

6. The outboard motor according to claim 1, wherein a pump opening is formed in a portion of the casing which corresponds to a location of the water pump, and at least the portion of the water pump in which the impeller is housed protrudes outside from the pump opening.

7. The outboard motor according to claim 1, wherein an inner casing member on which the water pump is mounted is provided in the casing, a plurality of components defining the water pump are interposed between the inner casing member and one of the components of the water pump in which the impeller is housed, the component in which the impeller is housed and the others of the plurality of components are together fastened to the inner casing member by a first bolt, and the plurality of components are fastened together by a second bolt.

8. The outboard motor according to claim 1, wherein an inner casing member on which the water pump is mounted is provided in the casing, a plurality of components defining the water pump are interposed between the inner casing member and one of the plurality of components of the water pump in which the impeller is housed, the plurality of components are together fastened to the inner casing member by a first bolt, and the component in which the impeller is housed and another of the components arranged to contact the component in which the impeller is housed are fastened together by a second bolt.

9. The outboard motor according to claim 7, wherein a coolant suction port and a coolant discharge port of the water pump are provided in the component in which the impeller is housed, and pipeline members connected to the coolant suction port and the coolant discharge port are defined by flexible hoses.

10. The outboard motor according to claim 8, wherein a coolant suction port and a coolant discharge port of the water pump are provided in the component in which the impeller is housed, and pipeline members connected to the coolant suction port and the coolant discharge port are defined by flexible hoses.

* * * * *